US005232166A

United States Patent [19]

Reiter

[11] Patent Number: 5,232,166

[45] Date of Patent: Aug. 3, 1993

[54] INJECTION VALVE

[75] Inventor: Ferdinand Reiter, Markgroeningen, Fed. Rep. of Germany

[73] Assignee: Robert Bosch GmbH, Stuttgart, Fed. Rep. of Germany

[21] Appl. No.: 872,252

[22] Filed: Apr. 22, 1992

[30] Foreign Application Priority Data

Apr. 26, 1991 [DE] Fed. Rep. of Germany ..... 4113682

[51] Int. Cl.[5] ..... F02M 51/08; F02M 61/18

[52] U.S. Cl. ..... 239/585.4; 239/585.1; 239/900

[58] Field of Search ..... 239/585.1-585.5, 239/900; 285/379

[56] References Cited

U.S. PATENT DOCUMENTS 3,847,421 11/1974 Field ..... 285/379
4,463,955 8/1984 Delhaes ..... 285/379
4,747,384 5/1988 Hafner et al. ..... 239/585.1
4,844,515 7/1989 Eschbaugh et al. ..... 285/379

FOREIGN PATENT DOCUMENTS 0348786 1/1990 European Pat. Off. .

*Primary Examiner*—Andres Kashnikow
*Assistant Examiner*—Lesley D. Morris
*Attorney, Agent, or Firm*—Edwin E. Greigg; Ronald E. Greigg

[57] ABSTRACT

An injection valve, having an annular groove on opposite ends on the circumference of the valve body. A retaining ring embodied from a bowed length of wire is retained in each of these grooves. A retaining ring having a spring tension can be mounted simply and economically on the circumference of the valve body and can be secured by snapping into place. The valve may be used as an injection valve for fuel injection systems.

19 Claims, 3 Drawing Sheets

INJECTION VALVE

BACKGROUND OF THE INVENTION

The invention is based on an injection valve as defined hereinafter. European Patent Document No. 0 348 786 A2 discloses a valve that has a sealing ring on the circumference of its fuel delivery neck, which seals off the area between the fuel delivery neck and a fuel delivery device. A retaining shoulder with a reduced diameter and a reduced wall thickness is formed on the circumference of one end of the fuel delivery neck. A retaining ring is slipped onto the retaining shoulder, and the retaining shoulder is subsequently deformed in such a way as to form an annular groove, in which the retaining ring is held, in the region of the retaining shoulder. The retaining ring limits the ability of the sealing ring to shift on the circumference of the fuel delivery neck in the direction of a longitudinal valve axis.

Securing the retaining ring on the circumference of the fuel delivery neck by means of a deformation of the fuel delivery neck is very complicated and increases the production costs for such an injection valve. Additionally, there is the danger that the deformation of the retaining shoulder will soil the valve interior with chips or other contaminants, which can cause problems during injection valve operation.

OBJECT AND SUMMARY OF THE INVENTION

The injection valve according to the invention has an advantage over the prior art that the retaining ring is mounted simply and economically on the circumference of the valve body and can be secured and held reliably in the annular groove by snapping into the annular groove formed on the valve body circumference, without the danger that the retaining ring could shift in the direction of the longitudinal valve axis.

The retaining ring itself, embodied from a bowed length of wire, can be produced very simply and economically.

The valve body can have a constant diameter in the axial direction, so that the valve body circumference can be machined very exactly and economically by centerless grinding.

It is especially advantageous if the retaining ring is polygonal in shape. The corners of such a retaining ring protrude radially particularly far past the circumference of the valve body. This securely and reliably prevents shifting of the sealing ring past the retaining ring in the direction of the longitudinal valve axis, even if the retaining ring has a reduced cross section. A reduced cross section of this kind leads to low production costs for the retaining ring and means that lesser forces are needed to assemble it.

To prevent damage to the sealing ring as it rests on the retaining ring and to prevent creating chips of material when the retaining ring is mounted on the circumference of the valve body, it is advantageous if the retaining ring has a circular cross section.

To assure a secure and reliable hold of the retaining ring in the annular groove, it is advantageous if the retaining ring is held in the annular groove of the valve body with a radially inwardly oriented tension.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
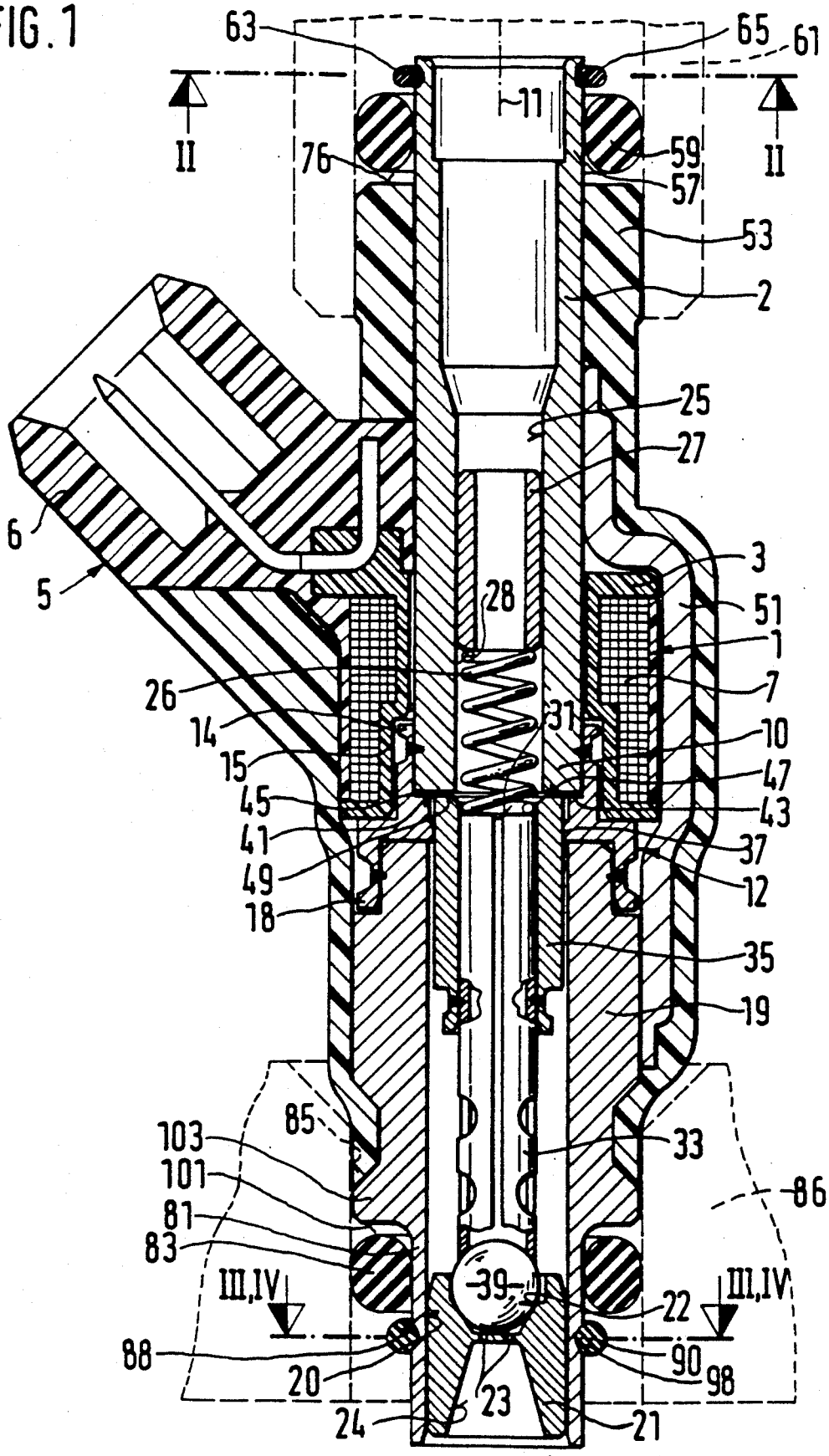
FIG. 1 shows an injection valve with two retaining rings embodied according to the invention.

The electromagnetically actuatable fuel injection valve, shown by way of example in FIG. 1, for fuel injection systems of mixture-compressing internal combustion engines with externally supplied ignition has a core 2 surrounded by a magnet coil 1 and serving as a fuel delivery neck. The core 2, which forms a valve body, has a constant outside diameter for the sake of maximal utilization of the space over its entire length; its circumference is machined, for instance by centerless grinding. The magnet coil 1 having a coil body 3 is provided with a plastic extrusion 5, and an electrical connection plug 6 is extruded along with it at the same time. Together with the core 2 having a constant outside diameter, the magnet coil 1, which in the radial direction has the stepped coil body 3 with a radially stepped winding 7, enables a particularly compact structure of the fuel injection valve.

A tubular metal intermediate part 12 is tightly joined, for instance by welding, to a lower valve end 10 of the core 2, concentric with a longitudinal valve axis 11, and with an upper cylindrical segment 14 it fits partway over the core end 10 axially. The stepped coil body 3 fits partway over the core 2, and with a step 15 of larger diameter fits partway over the upper cylindrical portion of the intermediate part 12. On its end remote from the core 2, the intermediate part 12 is provided with a lower cylindrical segment 18, which fits over a tubular connecting part 19 and is joined to that part, for instance by welding. A cylindrical valve seat body 21 is disposed in the downstream end of the connecting part 19, in a through bore 20 extending concentrically with the longitudinal valve axis 11. The linear succession of the core 2, intermediate part 12, connecting part 19 and valve seat body 21 makes a rigid metal unit and forms the valve body. The valve seat body 21, toward the magnet coil 1, has a fixed valve seat 22, downstream of which in the valve seat body 21 there are injection ports 23, for instance two in number. Downstream of the injection ports 23, the valve seat body 21 has a preparation bore 24 that widens frustoconically in the flow direction.

To adjust the spring force of a restoring spring 26, a tubular adjusting bush 27 is press-fitted into a flow bore 25 of the core 2, which extends in stepped fashion concentrically with the longitudinal valve axis 11. The restoring spring 26 rests with one end on a face end 28 of the adjusting bush 27 toward the valve seat body 21. The depth to which the adjusting bush 27 is fitted into the flow bore 25 of the core 2 determines the spring force of the restoring spring 26 and thus also influences the dynamic quantity of fuel injected during the opening and closing strokes of the valve.

By its end remote from the adjusting bush 27, the restoring spring 26 is supported in the downstream direction on a face end 31 of a connecting tube 33. A tubular armature 35, which is guided by a guide collar 37 of the intermediate part 12, is joined, for instance by welding, to the end toward the restoring spring 26 of the connecting tube 33. On the other end of the connecting tube 33, a valve closing body 39, for instance embodied as a ball, that cooperates with the valve seat 22 of the valve seat body 21 is joined to the connecting tube 33, for instance by welding.

An axial gap 45 is formed between an end face 41 of the core end 10 toward the armature 35 and a shoulder 43 of the intermediate part 12 leading to the upper cylindrical segment 14; disposed in this axial gap by clamping is a nonmagnetic stop disk 49 that forms a remanant air gap between an inlet-side face end 47 of the armature 35 and the face end 41 of the core end 10 and defines the stroke of the valve closing body 39 in the opening process of the valve.

The magnet coil 1 is surrounded by at least one guide element 51, embodied for instance as a hoop and serving as a ferromagnetic element, which rests by one end on the core 2 and by the other end on the connecting part 19 and is joined to it by welding or soldering, for instance. Part of the fuel injection valve is enclosed by a plastic sheath 53, which extends from the core 2 axially over the magnet coil 1 and the at least one guide element 51.

Figure 2:
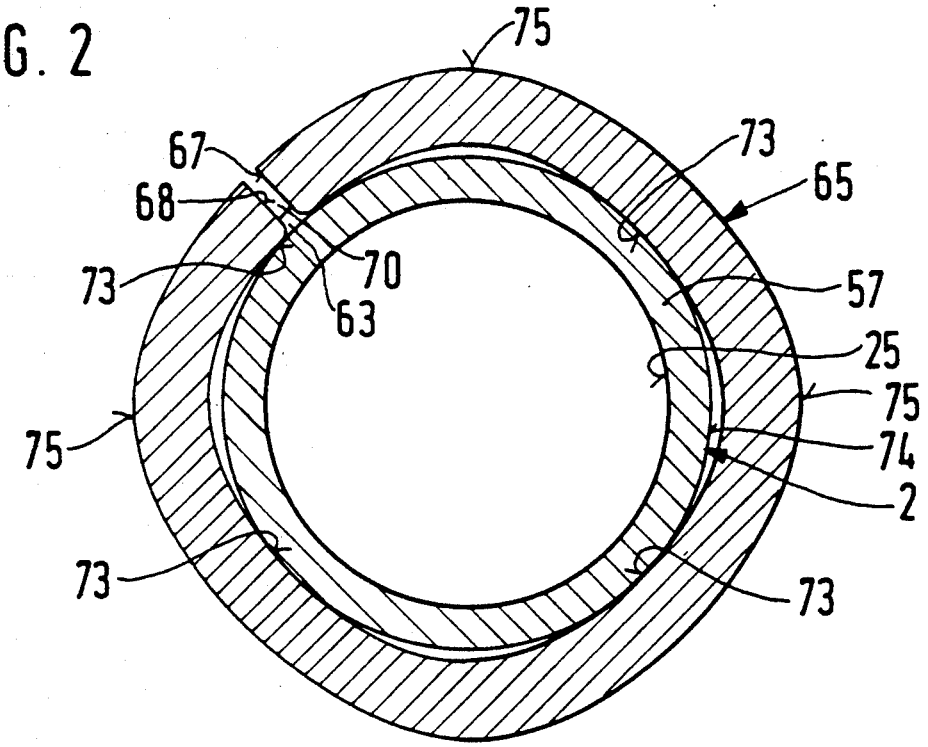
FIG. 2 shows a first exemplary embodiment of a retaining ring according to the invention, in a section taken along the line II—II of FIG. 1.

A sealing ring 59 is disposed on the circumference of an inlet-side connection end 57 of the core 2 forming the valve body and serving as the fuel delivery neck. The sealing ring 59 serves to provide a seal between the circumference of the connection end 57 and a fuel delivery device 61, known per se and shown in dashed lines in FIG. 1, which surrounds the fuel injection valve in the region of the connection end 57. Near the sealing ring 59 in the direction remote from the magnet coil 1, an encompassing annular groove 63 is formed on the circumference of the connection end 57 of the valve body; it has a round, approximately semicircular cross section, by way of example. However, the annular groove 63 may also have some arbitrary other cross section, for instance quadrangular or triangular. A retaining ring 65 is retained in the annular groove 63 and protrudes radially inward into it and also protrudes radially outward partway past the circumference of the connection end 57 of the valve body. The retaining ring 65 is formed from a bowed length of wire and as shown in FIG. 2, which is a section taken along the line II—II of FIG. 1, takes the form of a polygon, for instance a quadrangle. The inside diameter of the retaining ring 65 is by way of example smaller than the diameter of a groove bottom 74 of the annular groove 63, so that the retaining ring 65 rests on the bottom 74 of the annular groove 63 with a radially inwardly oriented tension.

Two ends 67, 68 of the length of wire forming the retaining ring 65 and for instance having a circular cross section, are not joined together but instead face one another with a distance between them, so that a gap 70 is formed between the two ends 67, 68. Such a circumferentially elastically deformable retaining ring 65 can very easily be mounted on the circumference of the connection end 57 of the core 2 forming the valve body in such a way that the retaining ring 65 snaps into place in the annular groove 63 and is retained therein. The quadrangular retaining ring 65 rests with its four edge segments 73 at least partially at a tangent on the groove bottom 74 of the annular groove 63. With its four corner segments 75, which are spaced radially apart from the bottom 74 of the annular groove 63 toward the outside, and partially with its edge segment 73, the retaining ring 65 protrudes radially outward past the circumference of the connection end 57 of the valve body.

The retaining ring 65, protruding at least partway to the outside radially past the circumference of the connection end 57, and a face end 76 toward the sealing ring 59 of the plastic sheath 53 of the fuel injection valve serve to retain the sealing ring 59 securely on the circumference of the connection end 57 when the fuel delivery device 61 is installed or dismantled, and to limit the shiftability of the sealing ring 59 in the direction of the longitudinal valve axis 11 on the circumference of the connection end 57.

Figure 3:
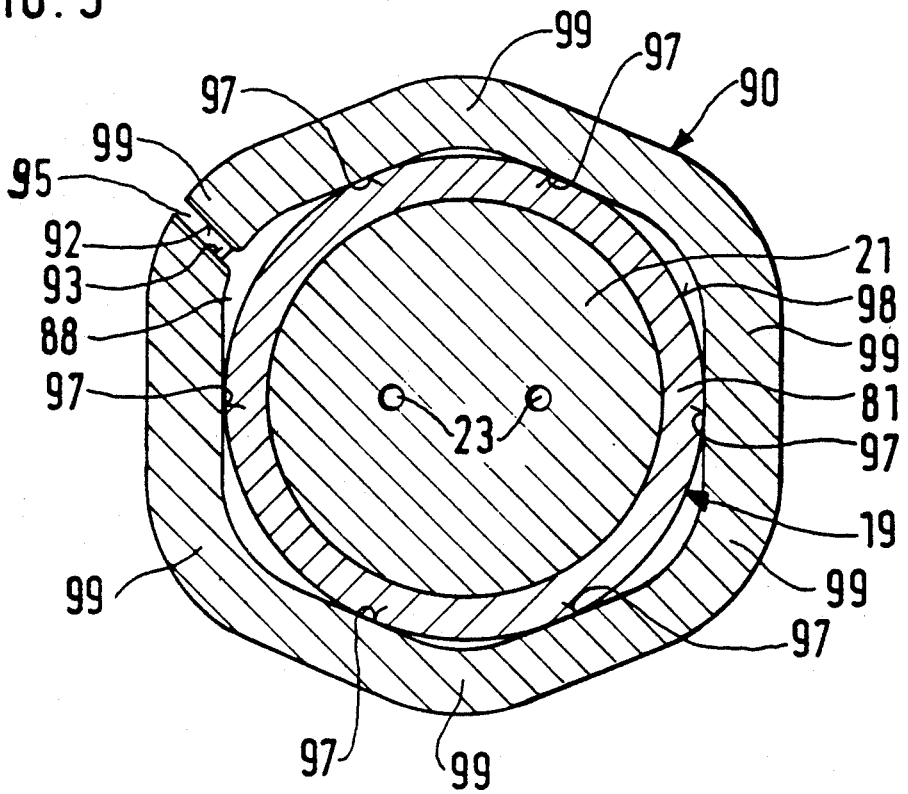
FIG. 3 shows a second exemplary embodiment of a retaining ring according to the invention, in a section taken along the line III—III of FIG. 1.

A sealing ring 83 is disposed on the circumference of a downstream valve end 81 of the connecting part 19 forming the valve body. The sealing ring 83 serves to form a seal between the circumference of the valve end 81 and a valve receiving opening 85, known per se and shown by way of example in dashed lines in FIG. I, such as an engine intake tube 86. An annular groove 88 of round, approximately semicircular cross section, by way of example, is formed out of the circumference of the valve end 81 of the valve body, remote from the magnet coil 1 and near the sealing ring 83. However, the annular groove 88 may also have any other arbitrary cross section, such as quadrangular or triangular. A retaining ring 90 is held in the annular groove 88, protruding radially inward partway into the annular groove 88 and protruding radially outward partway past the circumference of the valve end 81. The retaining ring 90 is formed from a bowed length of wire, has a circular cross section, for example, and as shown in FIG. 3, which is a section taken along the line III—III of FIG. 1, takes the form of a polygon, for example a hexagon. The inside diameter of the retaining ring 90 is smaller, for instance, than the diameter of a groove bottom 98 of the annular groove 88, so that the retaining ring 90 rests on the bottom 98 of the annular groove 90 with a radially inwardly oriented tension.

The bowed length of wire forming the retaining ring 90 has two ends 92, 93, which are not joined together but instead face one another at a distance, so that a gap 95 is formed between the two ends 92, 93.

The elastic deformability of the retaining ring 90 in the circumferential direction, resulting from the fact that the ends 92, 93 are not joined together, enables simple installation of the sealing ring 90 on the circumference of the valve end 81 of the valve body, so that the retaining ring 90 snaps into place in the annular groove 88 and is retained therein without the danger of shifting of the retaining ring 90 in the direction of the longitudinal valve axis 11. With its six edge segments 97, the hexagonal retaining ring 90 rests partly tangentially on the bottom 98 of the annular groove 88 and in this way is retained on the circumference of the valve body. The retaining ring 90 has six corner segments 99, which are radially spaced apart from the bottom 98 of the annular groove 88 in the radially outward direction. With its six corner segments 99 and some of its edge segments 97, the retaining ring 90 protrudes radially outward past the circumference of the valve end 81 of the valve body.

The retaining ring 90, protruding at least part way outward past the circumference of the valve end 81, and a face end 101, toward the sealing ring 83, of a retaining shoulder 103 of the connecting part 19 serve to keep the sealing ring 83 securely on the circumference of the valve end 81 of the valve body upon installation of the fuel injection valve in and removal from the valve receiving opening 85 of the intake tube 86, and to limit the shiftability of the sealing ring 83 on the circumference of the valve end in the direction of the longitudinal valve axis 11.

However, it is also possible for the edge segments 73, 97 of the retaining ring 65, 90 not to protrude out of the annular groove 63, 88, and for only the corners 75, 99 to extend radially outward past the circumference of the connection end 57 and the valve end 81, respectively.

Figure 4:
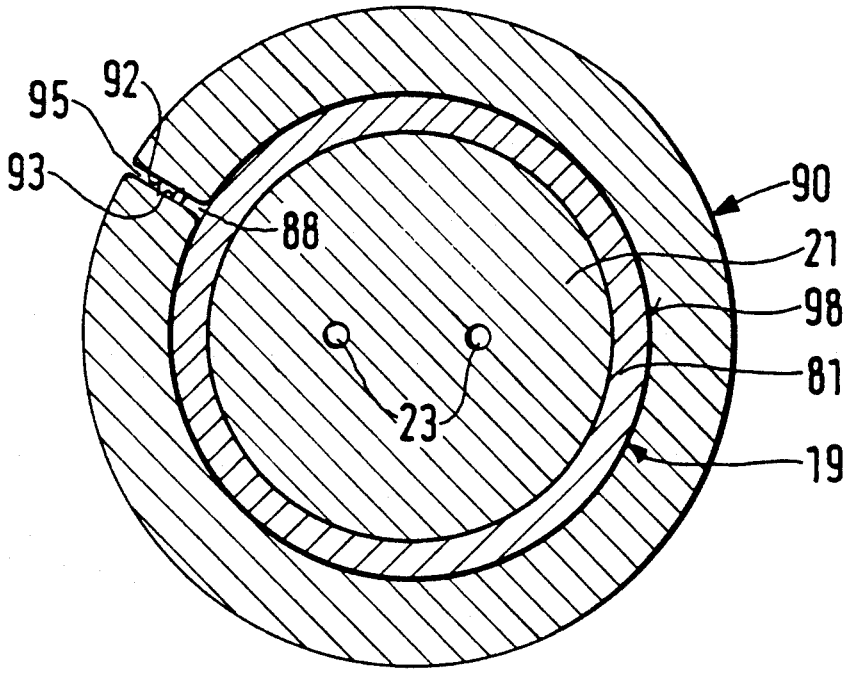
FIG. 4 shows a third exemplary embodiment of a retaining ring according to the invention, in a section taken along the line IV—IV of FIG. 1.

FIG. 4 shows a third exemplary embodiment of the retaining ring according to the invention, in a section taken along the line IV—IV of FIG. 1. Elements that are the same and function the same are identified by the same reference numerals as in FIGS. 1-3. The retaining ring 90, which takes the form of a circular ring and is formed from a bowed length of wire, for instance of circular cross section, is disposed on the circumference of the valve end 81 of the connecting part 19 forming the valve body. By way of example, the retaining ring rests on the bottom 98 of the annular groove 88 with a tension oriented radially inward, and in the radial direction it protrudes partway outward past the circumference of the valve end 81 of the valve body. The two ends 92, 93 of the retaining ring 90 face one another with a distance between them, so that a gap 95 is formed between the two ends 92, 93. Because of the resultant elastic deformability of the retaining ring 90 in the circumferential direction, this ring can easily be mounted on the circumference of the valve end 81, thereby locking into place in the annular groove 88 and thus being retained in the annular groove without there being any danger of shifting of the retaining ring 90 in the direction of the longitudinal valve axis 11.

Figure 5:
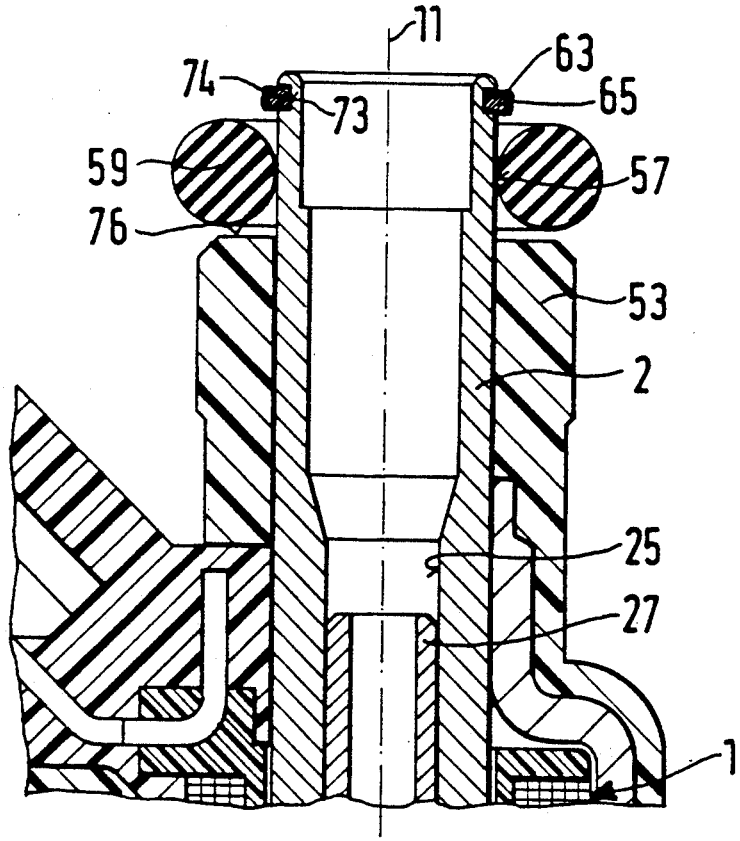
FIG. 5 is a fragmentary view of an injection valve, with a fourth embodiment of a retaining ring according to the invention.

FIG. 5 shows part of a fuel injection valve similar to that shown in FIG. 1, with a retaining ring in accordance with a fourth exemplary embodiment. Elements that are the same and function the same are identified by the same reference numerals as in FIGS. 1-4. The sealing ring 59 is disposed on the circumference of the connection end 57 of the core 2, which serves as a fuel delivery neck and forms the valve body. Near the sealing ring 59, remote from the magnet coil 1, the encompassing annular groove 63, of rectangular cross section, for instance, is formed on the circumference of the connection end 57. The retaining ring 65 is formed from a bowed length of wire, has a rectangular cross section, for example, and is in the form of a hexagon, for example. The retaining ring 65, which is open at its ends, is elastically deformable in the circumferential direction and can thus be easily mounted on the circumference of the connection end 57 of the core 2 forming the valve body; the retaining ring 65 snaps into place in the annular groove 63 and is thus retained in the annular groove 63. The retaining ring 65 rests (for example with a tension oriented radially inward) at least partially tangentially on the groove bottom 74 of the annular groove 63 with its edge segments 73, and with its corner segments 75, for instance six in number, and partially with its edge segments 73 it protrudes outward past the circumference of the connection end 57 of the valve body, as for instance shown in FIG. 2.

The retaining rings 65, 90 can be manufactured and installed simply and economically, in that in a first method step a length of wire is cut, for instance from a spring steel wire; in a second method step, the length of wire is bowed to make the retaining ring 65, 90; and in a third method step, the retaining ring 65, 90 is mounted on the circumference of the connection end 57 of the core 2 or on the valve end 81 of the connecting part 19, as applicable, in such a manner that the retaining ring 65, 90 snaps into place in the annular groove 63, 88 formed on the circumference of the connection end 57 or valve end 81 and is retained in that annular groove.

The retaining ring 65, 90 can easily be mounted on the circumference of the valve body 57, 81 and fixed in the annular groove 63, 88 formed on the circumference of the valve body by snapping into place in it. The retaining ring 65, 90 itself, comprising a bowed length of wire, can be produced very simply and economically.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An injection valve for fuel injection systems of internal combustion engines, having a valve body, at least one annular groove formed in a circumference of said valve body, at least one retaining ring disposed on the circumference of the valve body and retained in said at least one annular groove formed on the circumference of the valve body, and the at least one retaining ring (65, 90) is formed from a bowed length of wire which takes the form of a polygon.

2. An injection valve as defined by claim 1, in which the at least one retaining ring (65) is disposed on the circumference of a core (2) serving as a fuel delivery neck and is retained in the at least one annular groove (63) formed on the circumference of the core (2).

3. An injection valve as defined by claim 1, in which of the retaining ring (65, 90) has a circular cross section.

4. An injection valve as defined by claim 1, in of the retaining ring (65, 90) has a quadrangular cross section.

5. An injection valve as defined by claim 1, in which the at least one retaining ring (65, 90) is embodied of a spring steel.

6. An injection valve as defined by claim 1, in which the at least one retaining ring (65, 90) is retained in the annular groove (63, 88) of the valve body (57, 81) with a radially inwardly oriented tension.

7. An injection valve as defined by claim 1 which includes at least one sealing ring disposed on the circumference of the valve body, and a shiftability of said sealing ring in a direction of a longitudinal valve axis on the circumference of the valve body is limited by the at least one retaining ring.

8. An injection valve as defined by claim 7, in which the at least one retaining ring (65) is disposed on the circumference of a core (2) serving as a fuel delivery neck and is retained in the at least one annular groove (63) formed on the circumference of the core (2).

9. An injection valve as defined by claim 7, in which the at least one retaining ring (65, 90) is retained in the annular groove (63, 88) of the valve body (57, 81) with a radially inwardly oriented tension.

10. An injection valve as defined in claim 1 which includes two retaining rings and two annular grooves on opposite ends of said injection valve.

11. An injection valve as defined in claim 7 which includes two retaining rings and two annular grooves on opposite ends of said injection valve.

12. An injection valve for fuel injection systems of internal combustion engines, having a valve body, at least one annular groove formed in a circumference of said valve body, at least one retaining ring disposed on the circumference of the valve body and retained in said at least one annular groove formed on the circumference of the valve body, and the at least one retaining ring (65, 90) is formed from a bowed length of wire which takes the form of a quadrangle.

13. An injection valve for fuel injection systems of internal combustion engines, having a valve body, at least one annular groove formed in a circumference of said valve body, at least one retaining ring disposed on the circumference of the valve body and retained in said at least one annular groove formed on the circumference of the valve body, and the at least one retaining ring (65, 90) is formed from a bowed length of wire which takes the form of a hexagon.

14. An injection valve as defined by claim 12, in which the at least one retaining ring (65) is disposed on the circumference of a core (2) serving as a fuel delivery neck and is retained in the at least one annular groove (63) formed on the circumference of the core (2).

15. An injection valve as defined by claim 13, in which the at least one retaining ring (65) is disposed on the circumference of a core (2) serving as a fuel delivery neck and is retained in the at least one annular groove (63) formed on the circumference of the core (2).

16. An injection valve as defined by claim 12, in which the at least one retaining ring (65, 90) is retained in the annular groove (63, 88) of the valve body (57, 81) with a radially inwardly oriented tension.

17. An injection valve as defined by claim 13, in which the at least one retaining ring (65, 90) is retained in the annular groove (63, 88) of the valve body (57, 81) with a radially inwardly oriented tension.

18. An injection valve as defined by claim 13 which includes at least one sealing ring disposed on the circumference of the valve body, and a shiftability of said sealing ring in a direction of a longitudinal valve axis on the circumference of the valve body is limited by the at least one retaining ring.

19. An injection valve as defined by claim 13 which includes at least one sealing ring disposed on the circumference of the valve body, and a shiftability of said sealing ring in a direction of a longitudinal valve axis on the circumference of the valve body is limited by the at least one retaining ring.

* * * * *